United States Patent [19]

Nguyen et al.

[11] 4,286,676

[45] Sep. 1, 1981

[54] CRANK CONNECTOR FOR DIRECTIONAL DRILLING

[75] Inventors: Jean-Paul Nguyen, Rueil Malmaison; Emmanuel Laval, Paris; Andre Cendre, Cosne sur Loire, all of France

[73] Assignee: Institut Francais du Petrole, Rueil-Malmaison, France

[21] Appl. No.: 60,110

[22] Filed: Jul. 24, 1979

[30] Foreign Application Priority Data

| | | | |
|---|---|---|---|
| Jul. 24, 1978 | [FR] | France | 78 22063 |
| Apr. 6, 1979 | [FR] | France | 79 08803 |
| Apr. 6, 1979 | [FR] | France | 79 08804 |

[51] Int. Cl.[3] ..... E21B 7/08

[52] U.S. Cl. ..... 175/74; 64/2 R; 175/320

[58] Field of Search ..... 175/61, 73, 74, 75, 175/76, 40, 45, 320; 166/240; 64/1 R, 2 R, 1 S, 11 R

[56] References Cited

U.S. PATENT DOCUMENTS

| | | | |
|---|---|---|---|
| 2,336,333 | 12/1943 | Zublin | 175/75 |
| 3,141,512 | 7/1964 | Gaskell et al. | 175/73 |
| 3,457,999 | 7/1969 | Massey | 175/73 |
| 3,593,810 | 7/1971 | Fields | 175/76 |
| 3,888,319 | 6/1975 | Bourne, Jr. et al. | 175/61 |
| 4,040,495 | 8/1977 | Kellner et al. | 175/61 |
| 4,077,657 | 3/1978 | Trzeciak | 175/74 |

FOREIGN PATENT DOCUMENTS

| | | | |
|---|---|---|---|
| 1494273 | 12/1977 | United Kingdom | 175/61 |
| 652321 | 3/1979 | U.S.S.R. | 175/61 |

*Primary Examiner*—James A. Leppink

*Attorney, Agent, or Firm*—Millen & White

[57] ABSTRACT

This connector comprises two tubular members connected to each other, one of which can pivot about a rotation axis which forms an acute angle with the axis of the two members. This axis of rotation and the axes of the two members converge to the same point.

Remote control means are operative to vary at will the relative angular position of the tubular members and means are adapted to lock said two members against relative rotation in a selected angular position.

17 Claims, 20 Drawing Figures

3
4
82
1b
81
80
A
78
20c
20a
79
20
20b
14
11
26
23
1
84
A
19
D
83
22
A
21
1a
2a
17
16
15
18
B
24
C
19
2b
25
2
85
2c
6
5
O
α
Δ

56
54
28
55
57
53
26

56
54
28
55
57
53
26

28
55
54
56
26
53
57

28
54
56
55
57
53
26

54
28
56
55
57
53
26

CRANK CONNECTOR FOR DIRECTIONAL DRILLING

BACKGROUND OF THE INVENTION

The present invention relates to a device of the type generally known as a crank connector to be positioned between the lower part of a drill string and a downhole motor rotating a drill bit, such coupling permitting to adjust the orientation of the drill path.

Many methods and devices have been proposed heretofore for carrying out directional drilling.

According to U.S. Pat. No. 3,365,007, the action of a suitably directed fluid jet is used for locally destroying ground formations so as to create a recess where the drill bit will be diverted. Obviously such a device cannot be accurate since the jet action and thus the resulting bit deflection will vary with the hardness of the geological formations. Moreover it is necessary to use a special drill bit provided with a nozzle for discharging the fluid jet.

According to another method, which is for example described in British Pat. No. 1,139,908, U.S. Pat. Nos. 3,593,810, 3,888,319, and 4,040,494 or in French Pat. No. 2,297,989, there is used a deflecting device surrounding a section of the drill string at its lower part, usually in the vicinity of the drill bit. This deflecting device is provided with a plurality of radial fingers displaceable with respect to the drill string axis. By suitably displacing these fingers which bear on the wall of the drilled borehole, it is possible to offset the drill bit axis with respect to the borehole axis, which results in a deflection of the drilling direction.

With such devices drilling is discontinuous as being performed in successive runs or trips between which drilling is stopped to permit the displacement of the deflecting device. This causes considerable time losses increasing the cost of each drilling operation.

In a present drilling technique making use of a downhole motor, it has been proposed to locate between the lower part of the drill string and the so-called drill head (i.e. the assembly of the drill bit and of the downhole motor) a crank connector of selected angle. However everytime the drilling direction is to be changed it is necessary to raise the whole drill string to the ground surface to change the crank connector to another one of appropriate angle, said angle being selected in dependence with the desired deflection.

New so-called hinged crank connectors have been described in French Pat. No. 1 252 703, or mentioned in French Pat. No. 2 175 620. Such connectors usually comprise two tubular parts hinged to each other and which can only take two relative positions. In a first position the two parts of the connector are aligned (the angle of the connector is then equal to zero), while in the second position of the connector the two parts thereof are at a preselected angle to each other. As with the crank connector of the above-described type it is necessary to raise to the surface at least one constituting element of the connector when the desired drilling deflection is not compatible with the angle which the two parts of the connector can form between each other.

SUMMARY OF THE INVENTION

The invention provides a crank connector which does not suffer from the drawbacks of the above devices. More precisely the invention relates to a crank connector consisting of two tubular elements forming between each other an angle which can be varied at will by remote control, preferably from a zero value to a maximum value.

Briefly stated, this goal is achieved by pivoting one of the tubular element of the connector about a rotation axis which is distinct from the respective axes of the two tubular elements and converges with said axes to one and the same point, such pivoting been achieved by using remote control means.

BRIEF DESCRIPTION OF THE DRAWINGS

The invention will be readily understood and its advantages made apparent from the following description, illustrated by the accompanying drawings, wherein.

DETAILED DISCUSSION OF THE INVENTION

Figure 1:
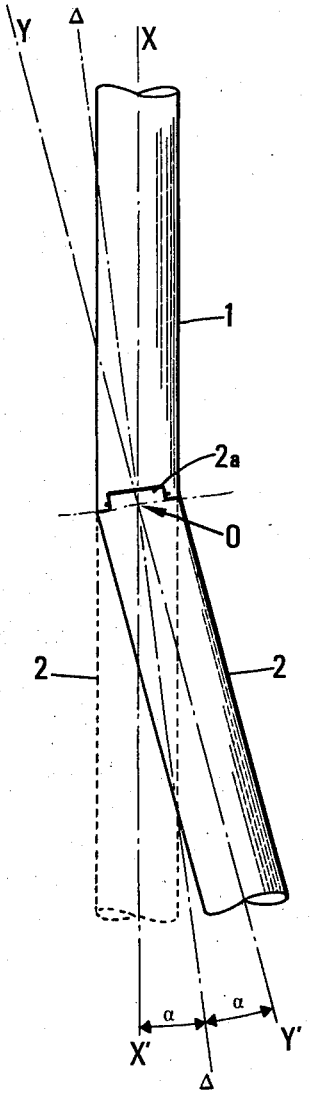
FIG. 1 diagrammatically illustrates the basic concept of the crank connector according to the invention.

FIG. 1 diagrammatically illustrates the basic concept of the crank connector according to the present invention.

This connector comprises two tubular members 1 and 2 connected to each other by a fitting element 2*a* having an axis Δ and which is for example fixed to member 2.

The axis X'X of tubular member 1, the axis Y'Y of tubular member 2 and the axis Δ converge to one and the same point 0.

The angles (Δ, X'X) and (Δ, Y'Y) formed by the axis Δ and the axes X'X and Y'Y respectively have the same value $\alpha$.

By continuous rotation of element 2 about axis $\alpha$, the angle formed by axes X'X and Y'Y can be varied between a maximum value $2\alpha$ (position of member 2 shown in solid line) and a zero value (position of member 2 indicated in dotted line).

The value $\alpha$ is selected as a function of the maximum value to give to the angle of the crank connector according to the invention. The rotation of member 2 about the axis Δ may be performed in a continuous manner, so that the angle (X'X, Y'Y) can be adjusted to any desired value between 0 and $2\alpha$.

However, this rotation may also be performed stepwise, two successive positions being separated by a rotation $\theta$ of member 2 about axis $\Delta$, so that $$\theta=[(2\pi)/n],$$

n being an integer selected so as to obtain n suitable values of the coupling angle, one of the n relative angular positions of members 1 and 2 preferably corresponding to a zero value of the angle (X'X, Y'Y).

Using as a reference the position of alignment of the two tubular members 1 and 2, the angle $\phi$ formed by the axes of these two members is given by the formula:

$$\cos\phi=1-2\sin^2\alpha\sin^2(\theta/2)$$

Figure 2:
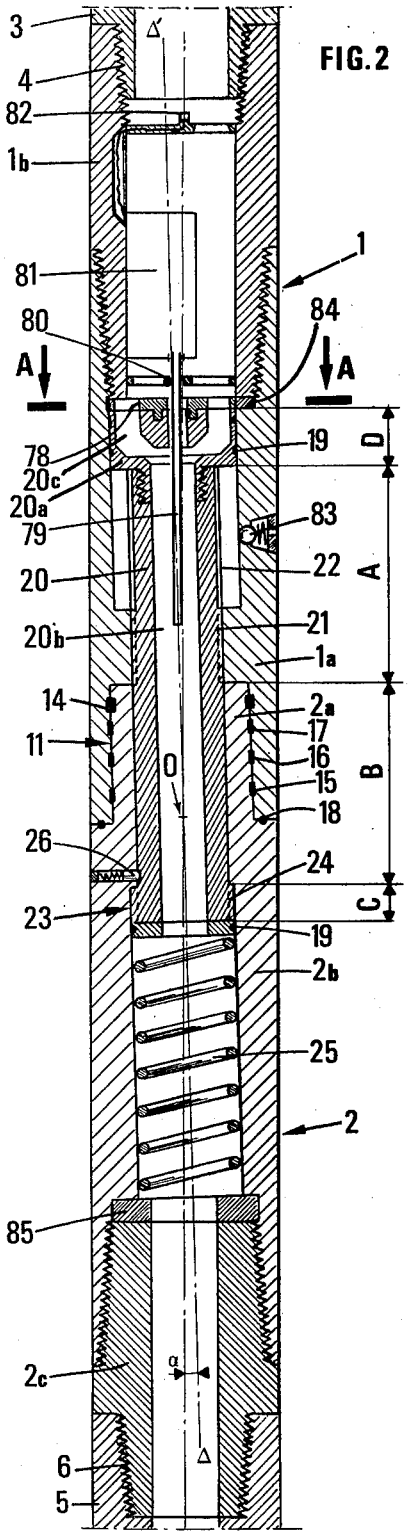
FIG. 2 is an axial cross-section view of a first embodiment of the invention.

FIG. 2 shows in a cross-section a first embodiment of the crank connector according to the invention in its position where the axes of the two tubular members are aligned.

The tubular member 1 which is, for example, made up by a plurality of elements 1*a*, 1*b* connected end to end, is secured to the lower part 3 of the drill string by a threading 4.

Member 2 formed of a plurality of elements 2*b*, 2*c* is screwed onto a downhole motor 5, such as a turbine, a volumetric or electric motor, by a threading 6.

The upper part of member 2 carries a fitting element 2*a* which is complementary to a bore 11 machined in the lower part of member 1. The fitting element 2*a* has an axis $\Delta$ such that $\Delta$ and the respective axes of members 1 and 2 converge to one and the same point 0.

The tubular elements 1 and 2 are held in their fitting position by a bearing 14 capable of withstanding the axial stresses applied to the connector in operation. The centering of element 2*a* in bore 11 is ensured by roll bearings such as those diagrammatically shown at 15, 16 and 17, which permit relative rotation of tubular members 1 and 2. Sealing is achieved by a gasket or joint 18.

A tubular connecting shaft 20 whose axis is in line with axis $\Delta$ makes members 1 and 2 fast in rotation with each other when in its upper position shown in FIG. 2 and rotates member 2 about axis $\Delta$ by an angle $\theta$ every time this shaft is moved downwardly.

Shaft 20 comprises four different functional parts:

1. In part A this shaft 20 is provided with grooves 22 co-operating with complementary grooves 21 machined in the bore of member 1 to make this member and shaft 20 fast in rotation, while permitting a relative axial displacement of this shaft.

Figure 3:
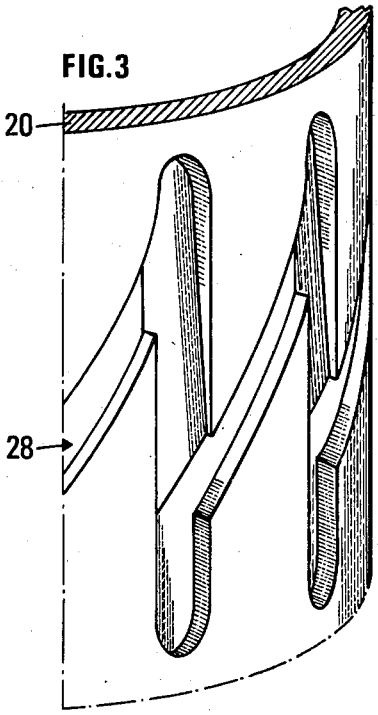
FIG. 3 is a perspective view of a portion of the guide groove of the device of the present invention.

2. In part B, shaft 20 is provided with a profiled guide slot 28 (FIG. 3) co-operating with at least one guide finger 26 carried by member 2. This finger is radially retractable into the wall of member 2, against the action of return springs which permanently hold this finger in contact with the bottom of groove 28 whose depth varies as shown in FIG. 3. Groove 28 and guide finger 26 co-operate to rotate member 2 as shaft 20 is moved downwardly.

3. In part C, shaft 20 is provided with grooves 23 (n teeth or a multiple of n), while the bore of member 2 is provided with complementary grooves 24. Grooves 23 and 24 make members 1 and 2 fast in rotation with each other when shaft 20 is in its upper position.

4. Part D of shaft 20 houses a remotely controlled device providing for the axial displacement of shaft 20 relative to member 1. This device may, for example, be operative to close a passage for the drilling fluid flowing through the bore of shaft 20.

Gaskets 19 seal the inner mechanism from the fluid flow.

In the piston-shaped head 20*a* of shaft 20, the inner bore 20*b* of shaft 20 which ensures the fluid flow, is subdivided into a plurality of peripheral channels 20*c*. On piston 20*a* is rotatably mounted a disc of circular plate 78 having passages corresponding to said channels 20*c* and which can be rotated by a selected angle, relative to piston 20*a* to partly or completely close the openings of channels 20*c* wherethrough the drilling fluid flows. Such rotation can be induced by a control rod 79 of flat cross-section at the level having disc 78 and passing through a slot of the later. Stem 79 is guided by a bearing 80 and is rotated by a rotary electromagnet 81 or by any other electromechanical means. Electric connection to the ground surface is ensured by an axial plug 82.

83 is a valve so calibrated as to permit a sufficient thrust to be exerted on piston 20*a*, as hereinunder explained.

84 is an annular abutment limiting the upward displacement of shaft 20 under the action of spring 25 bearing on ring 85.

This return spring 25 drives shaft 20 upwardly once the desired rotation $\theta$ has been achieved.

This device operates stepwise as indicated below, each step corresponding to a rotation by $\theta=[(2\pi/n)/n]$ of member 2 about axis $\Delta$.

After n rotation steps, corresponding to a complete revolution of member 2, this member is again at its initial position.

1. When the borehole has reached the depth at which the angle of crank connector must be modified, circulation of the drilling fluid is discontinued and the drill bit is lifted from the hole bottom;

2. The electro-mechanism 81 is energized to rotate disc 78, so as to close off the fluid passages in the piston-shaped head 20*a* of shaft 20.

Figure 4:
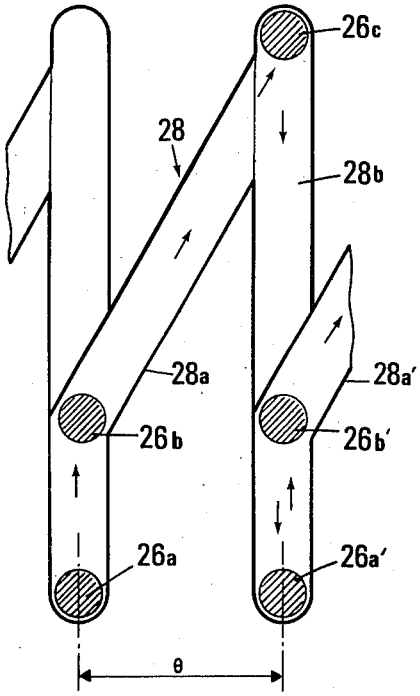
FIG. 4 is a developed view of said guide groove.

3. The circulation of the drilling fluid is started again;

4. The piston 20*a*, which is subjected to the pressure of the drilling fluid, displaces axially shaft 20 downwardly with reference to FIG. 2. The position of the guide finger 26 relative to groove 28 is modified. This finger 26 passes from position 26*a* to position 26*b* (FIG. 4) where grooves 23 and 24 are disengaged from each other, members 1 and 2 being no longer fast in rotation with each other;

5. A further axial displacement of shaft 20 then results in a rotation of member 2, finger 26 following the inclined portion 28*a* of groove 28 to reach position 26*c*, after a rotation of $\theta$. Piston 20*a* uncovers gauged valve 83 which limits the pressure of drilling fluid above the piston, thus warning the operator on the ground surface that the shaft 20*a* has travelled over its whole stroke.

Disc 78 remained in position of closing of channels 20*c* during the whole displacement of shaft 20, owing to a sufficient length of the control rod 79 along which the slot of disc 78 slides.

6. The fluid circulation is again discontinued;

7. The energization of the electro-mechanism 81 is interrupted. Rod 79 is urged back to its initial position by suitable mechanical return means (not shown), thereby rotating disc 78 which uncovers channels 20*c*;

8. The return spring 25 urges shaft 20 back to its initial position. The finger 26, which follows a groove portion 28b parallel to the axis of shaft 20, first reaches portion 26b' (FIG. 4) and then, 9. In the last part of the translation stroke of shaft 20 where finger 26 passes from position 26b' to position 26a', the grooves 23 of shaft 20 co-operate with the grooves 24 of member 2 to make tubular members 1 and 2 again fast in rotation with each other.

A further rotation $\theta$ can be obtained by repeating the above-described operating cycle. It should be noted that guide finger 26 will then take positions 26a' and 26b' successively and will then automatically engage a new groove portion 28a' owing to the depth difference in groove 28.

To ensure a correct passage from position 26c to position 26a', it is possible to use a locking device making members 1 and 2 fast in rotation with each other when shaft 20 is displaced under the action of spring 25 and disengaging them as soon as grooves 23 engage grooves 24.

Figure 5:
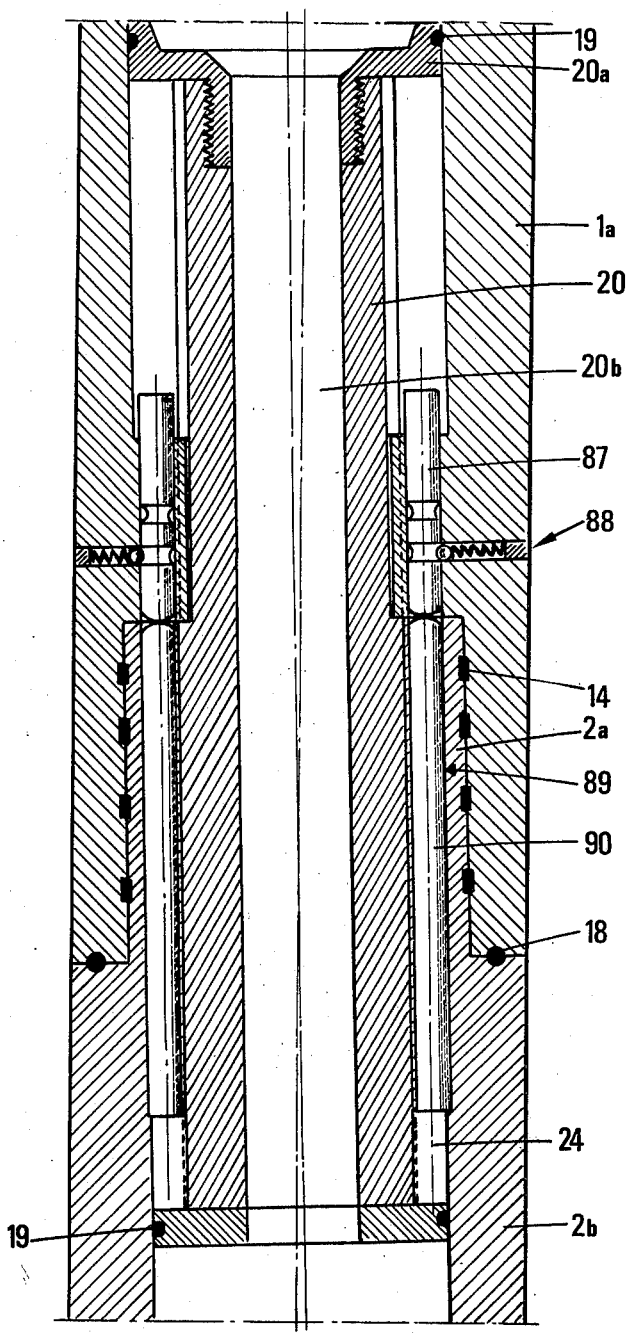
FIG. 5 shows auxiliary means of FIG. 5 for locking the elements of the crank connector against relative rotation.

This can be achieved, for example, as illustrated in FIG. 5, by means of at least one locking stud 87 carried by member 1 and held in position by locking ball means 88. Through member 2 is machined a bore 89 coaxial to stud 87 and of substantially the same diameter. This bore is so positioned as to open in the free space between two consecutive grooves 24 of member 2. Inside this bore is housed a return rod 90 of substantially the same length as bore 89.

Figure 6:
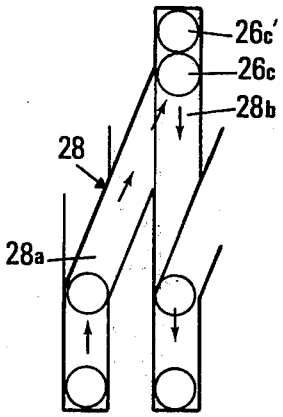
FIG. 6 illustrates the operation of this auxiliary locking means.

At the end of the rotation of member 2, an additional axial displacement of shaft 20 moves finger 26 from position 26c to position 26c' (FIG. 6). During this displacement, piston 20a bears on stud 87 and pushes the latter partly into bore 89, the end of rod 90 being placed between two grooves 24 of member 2. Stud 87 which is locked in this position by the locking device 88, makes then members 1 and 2 fast in rotation with each other. When shaft 20 is urged back to its upper position, finger 26 can then only follow the part 28b of groove 28 (FIG. 6). When grooves 23 and 24 come again into interlocking engagement, rod 90 is pushed back and stud 87 takes back its initial position.

Figure 7A:
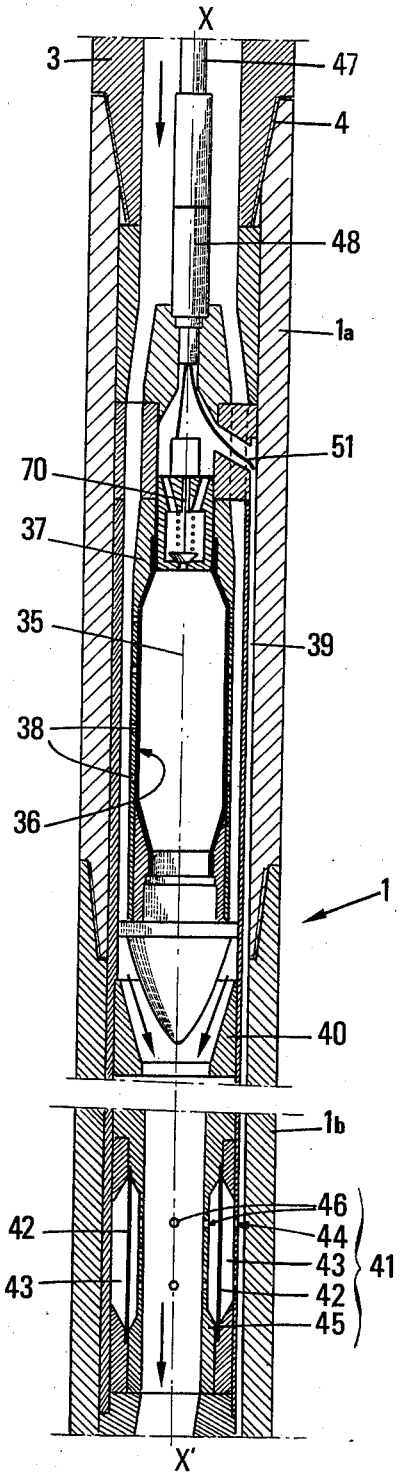
FIGS. 7A and 7B illustrate a second embodiment of the invention.
Figure 7B:
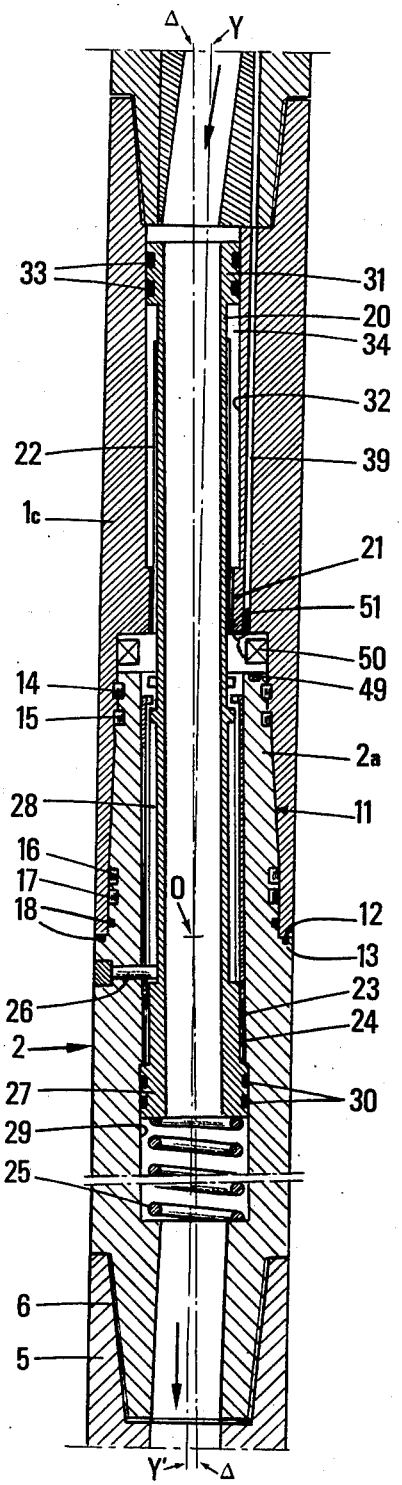

FIGS. 7A and 7B show in cross-section another embodiment of the crank connector according to the invention, which differs from the above-described embodiment by the remotely controlled mechanism for displacing shaft 20 and by the locking means.

In this embodiment the lower end of shaft 20 is extended by a hollow lower piston 27 which is slidable against the action of spring 25 in the bore 29 of element 2, the axis of this bore being aligned with the axis $\Delta$. Gaskets 30 ensure sealing between piston 27 and bore 29.

The upper end of shaft 20 is extended by a hollow piston 31 which is slidable in the bore 32 of element 1, the axis of this bore being aligned with the axis $\Delta$. Gaskets 33 ensure sealing between piston 31 and bore 32.

The external diameter 27 is greater than that of the upper piston 31.

Bores 29 and 32 and pistons 27 and 31 of shaft 20 delimit between each other a sealed annular space 34.

In the upper part of the bore of element 1 is housed a tank 35 containing a hydraulic fluid, such as oil. This tank has a wall 36 having at least one deformable wall portion which is for example made of neoprene. This tank is arranged in a rigid protecting housing 37 whose wall is provided with apertures 38 so that the drilling fluid flowing through the crank connector exerts its pressure on wall 36 of tank 35. A duct 39 through member 1 put space 34 and tank 35 in communication through a valve 70 having a closed and an open positions. The position of this valve, which is for example electrically operated, is remotely controlled from the surface as described below.

An element 40 operative to create a pressure drop in the flow of drilling fluid is placed above piston 27. More precisely this element will be located at an intermediate level between space 34 and tank 35. In the illustrated embodiment this element 40 is located in the bore of member 1, but it would also be possible, without departing from the scope of the present invention to place this element 40 in the bore of the hollow shaft 20.

A compensator, designated as a whole by reference 41, makes it possible, on the one hand, to maintain the fluid pressure in the confined space substantially at the same value as the pressure within the bore of member 2 when valve 70 is closed, and, on the other hand, compensates for hydraulic leakage.

This compensator comprises a flexible membrane 42 which delimits with the bore of member 1 an annular space 43 communicating with duct 39 through apertures 44. This membrane delimits with the body 45 of compensator 41 a space communicating with the inner part of the crank connector through apertures 46, downstream of element 40, which creates the pressure drop, when considering the direction of flow of the drilling fluid. The signals for controlling valve 70 are transmitted from the surface through a cable or line 47 which can be housed in the bore of the drill string 3 at the lower part thereof, or embedded in the wall of this drill string. An electric connector 48, which may be of a known type, provides for electric connection between cable 47 and electrically actuated valve 70. Means for detecting the relative position of the two members 1 and 2 of the crank connector may be provided. Such means will, for example, comprise a magnetic element, such as a permanent magnet 49, secured at the end 2a of tubular member 2, and a set of switches 50, secured to member 1. These switches will be, for example, of a type having a flexible blade such as those sold by Radiotechnique under reference R 122. In each position of member 2, magnet 49 will energize only one switch 50. Detection of this particular switch gives the relative angular position of members 1 and 2. To this end these switches may be connected to the ground surface through electrical conductors 51, electrical connector 48 and cable 47. The operation of the crank connector is described hereinafter with reference to the drawings and assuming an initial aligned position of members 1 and 2. The connector is in the position shown in FIGS. 7A and 7B and the electrically actuated valve 70 is closed.

The drilling fluid flows in the direction indicated by the arrows to feed the downhole motor 5 when the latter is, for example, a turbine, and for flushing the drill bit, not shown. The pressure $P_1$ of the hydraulic fluid in tank 35 is equal to the pressure of the drilling fluid feeding the crank connector. The element 40 creates a pressure drop $\Delta P$ in the flow of drilling fluid. The value $P_2$ of the pressure downstream of element 40 is lower than $P_1$ and equal to $P_2 = P_1 \Delta P$.

The pressure of the hydraulic fluid in the above-defined annular space 34 is maintained by compensator 41 at a value substantially equal to $P_2$. The gauged spring 25 maintains then shaft 20 in its upper position shown in FIG. 7B. The guide finger 26 is in its position 26a shown in FIG. 4.

When it is desired to modify the angle of the crank connector, a control signal is transmitted from the surface through cable 47 while maintaining the flow rate of drilling fluid.

This control signal opens valve 70 which puts tank 35 into communication with the annular space 34 through duct 39. The hydraulic fluid in space 34 being then at the pressure $P_1$ acts on the lower piston 27 and displaces the latter against the action of spring 25, the annular space 34 being fed from tank 35. The guide finger first reaches position 26*b* (FIG. 4); the grooves 23 of shaft 20 and 24 of member 2 are released from each other. The lower piston 27 being further displaced, the guide finger 26 passes from position 26*b* to position 26*c* while rotating member 2 about axis Δ by an angle $\theta=[2\pi)/n]$.

When finger 26 is in position 26*c* a control device, comprising for instance an electrical contact (not shown), transmits this information to the surface.

The detection means 50 may optionally make up this control means.

The flow of drilling fluid is then interrupted.

The pressure of hydraulic fluid in tank 35 and annular space 34 becomes then substantially equal to the pressure of the drilling fluid in tubular member 2. The gauged spring 25 moves shafy 20 back upwardly (FIG. 7B), forcing back the hydraulic fluid into tank 35. Finger 26 first reaches position 26*b'*, then position 26*a'* wherein member 2 and shaft 20 are again fast in rotation with each other. Valve 70 is then closed.

These operations can then be repeated until the angle of the crank connector has reached the desired value.

Valve 70 being closed, the drilling operation may be started again by restoring the flow of drilling fluid.

Figure 8:
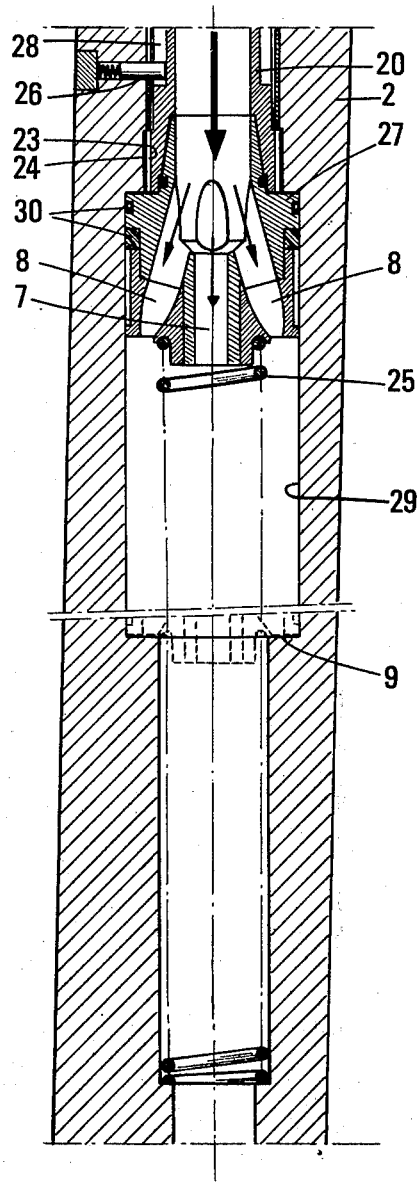
FIG. 8 shows an embodiment of the means for detecting the displacement of the coupling shaft.

FIG. 8 shows another embodiment of the means indicating when finger 26 has reached its position 26*c*.

In this embodiment the lower piston 27 establishes a communication between the bore of shaft 20 and shaft 29 of number 2 through an axial duct 7 and one or a plurality of lateral ducts 8. Moreover the bore is provided with an annular shoulder 9 which is, in the lower position of piston 27, (shown in dashed line in FIG. 8), obturates the lateral ducts 8. Thus when piston 27 reaches shoulder 9, this causes a variation in the flow conditions of the drilling fluid and such variation can be sensed from the surface.

Figure 9:
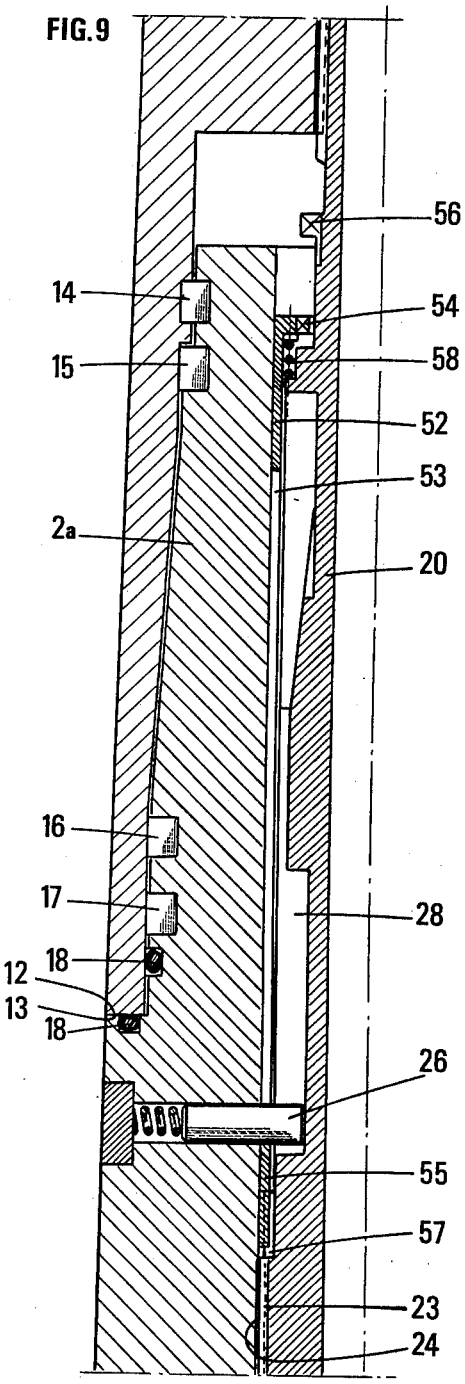

Another embodiment of the means for interlocking members 1 and 2, when piston 20 is in its lower position, is illustrated in FIGS. 9 to 11E. These locking means comprise a ring or sleeve 52 covering the guiding slot 28 (FIG. 9). This ring is provided with at least one groove 53 receiving the guide finger 26. This groove is shown in developed view in FIG. 10. At each of its ends, the sleeve 53 is provided with teeth 54 and 55 adapted to engage teeth 56 and 57 of shaft 20. A spring 58 located between shaft 20 and sleeve 52 tends to move the latter so that teeth 54 and 56 engage one another.

Operation is illustrated in FIGS. 11A to 11E. In these diagrammatic drawings, groove 53 has been shown as a hatched surface to facilitate understanding of the drawing.

Figures 11A, 11B, 11C, 11D, 11E:
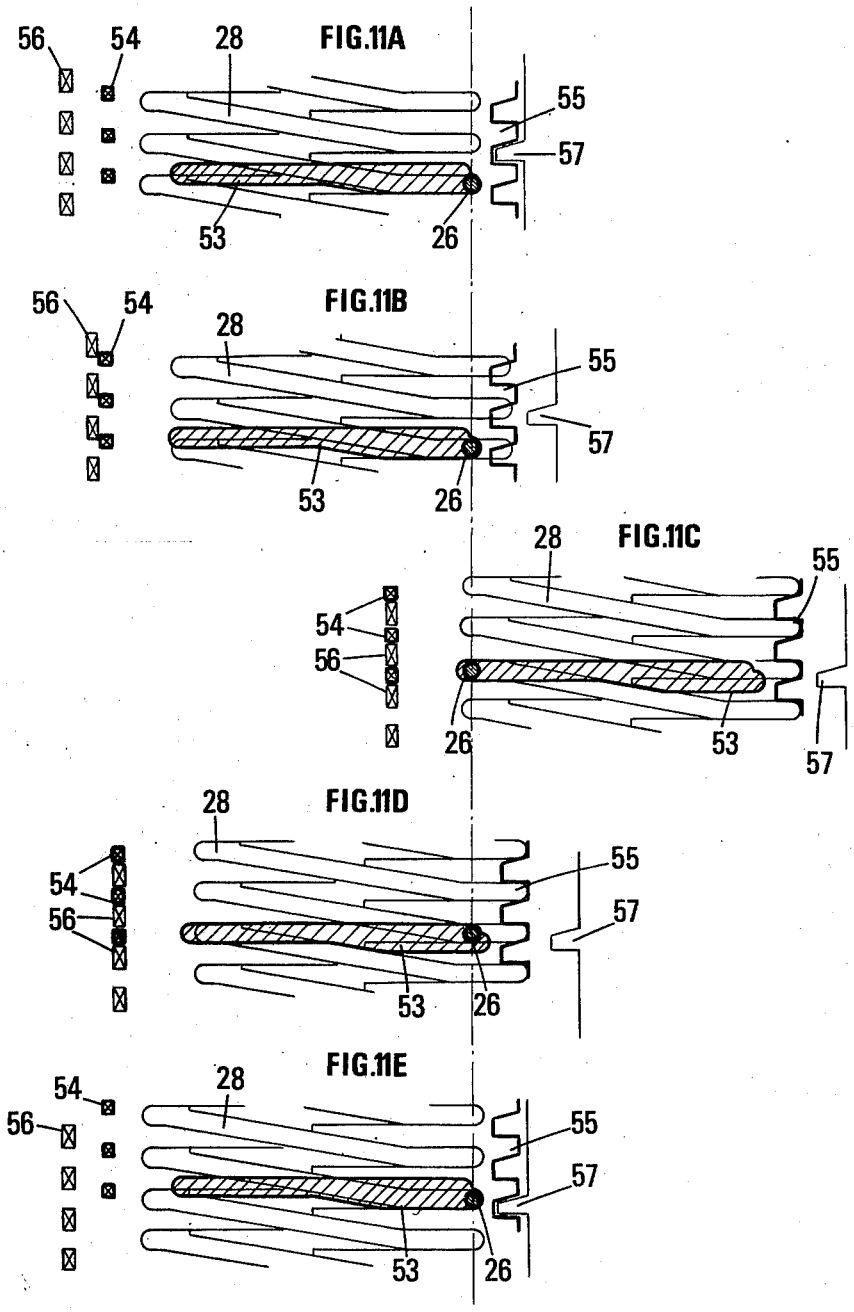
FIGS. 11A to 11E illustrate the operation of the locking ring.

During the drilling operation sleeve 52 is in the position shown in FIG. 11A, teeth 55 and 57 being engaged to make sleeve 52 fast in rotation with shaft 20. When shaft 20 is axially displaced, the relative positions of groove 28 and 53 are successively those illustrated in FIG. 11B where teeth 55 and 57 are released from one another, then in FIG. 11C, where, under the action of spring 58 and after a rotation of sleeve 52 driven by guide finger 26, teeth 54 and 56 make sleeve 52 fast in rotation with shaft 20. Under these conditions an axial displacement of shaft 20 in the reverse direction will be effected without any relative rotation with respect to guide finger 26 (FIG. 11D). Sleeve 52 and shaft 20 are again made fast in rotation with each other through teeth 55 and 57 (FIG. 11E).

Figure 12:
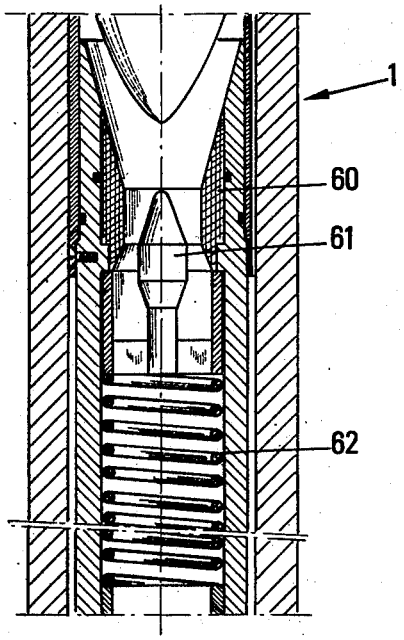
FIG. 12 shows means for creating a predetermined pressure drop in the flow of drilling fluid.
Figure 10:
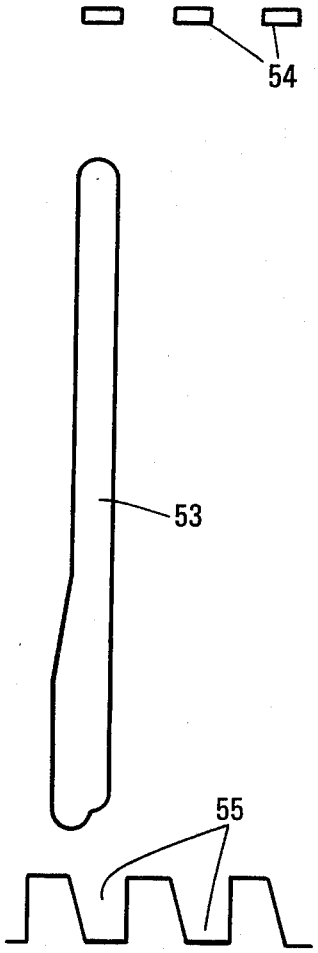
FIGS. 9 and 10 show the locking ring which cooperates with the guide groove.

FIG. 12 shows an embodiment of an element 40 for creating in the flow of drilling fluid a pressure drop whose value is determined in dependence with the fluid flow rate.

In this embodiment element 40 is made of a member 60 providing a reduction in the diameter of the bore of member 1. A movable element 61 is displaceable in the bore of this element under the action of a gauged spring 62. In the illustrated embodiment element 61 is so profiled that the pressure drop in the flow of drilling fluid is substantially independent of the flow rate. To this purpose the end of element 61 is of generally conical shape. An increase in the flow rate tends to increase the pressure drop. Element 61 is then displaced against the action of gauged spring 62 and takes a now position of equlibrium corresponding to the initial pressure drop for which spring 62 has been calibrated.

Figure 13A:
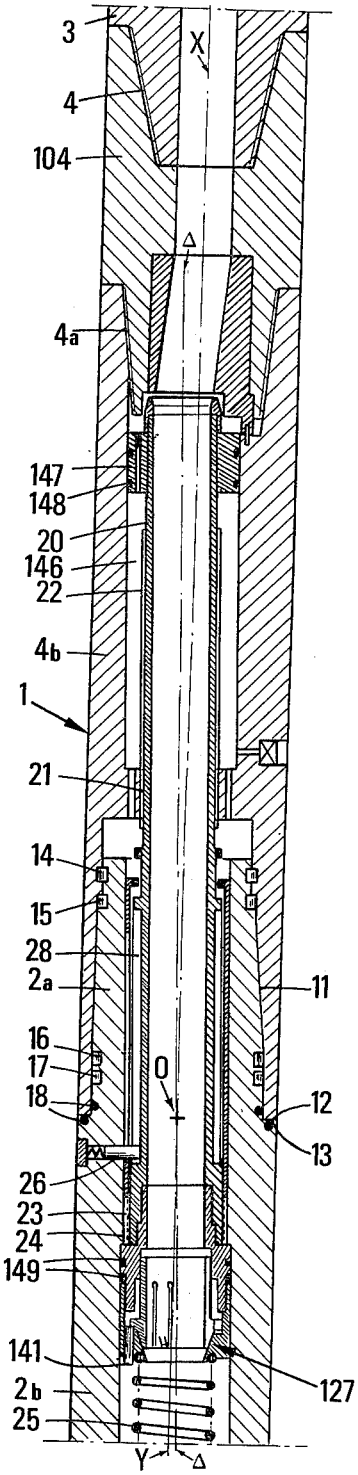
FIGS. 13A and 13B illustrate a third embodiment of the invention.
Figure 13B:
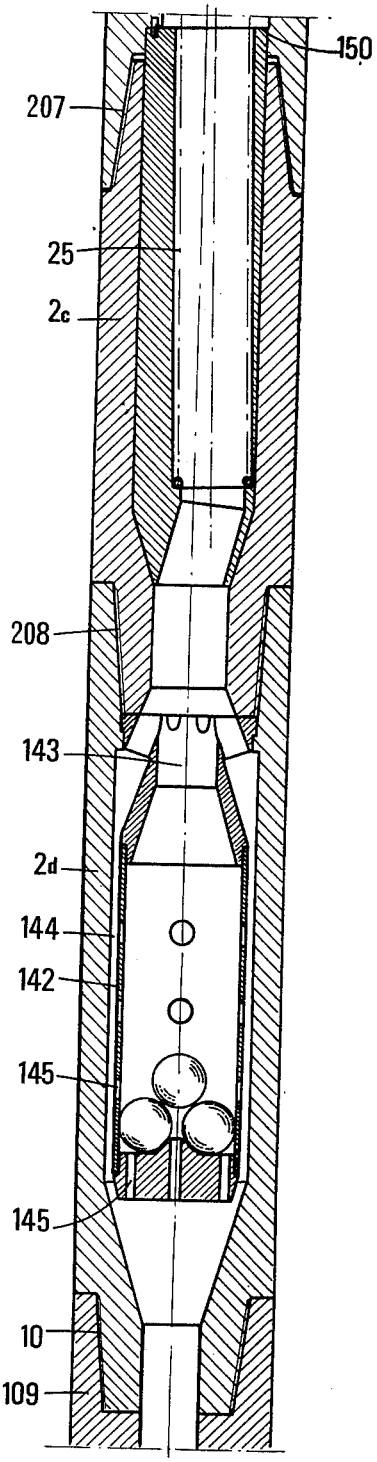
Figure 14:
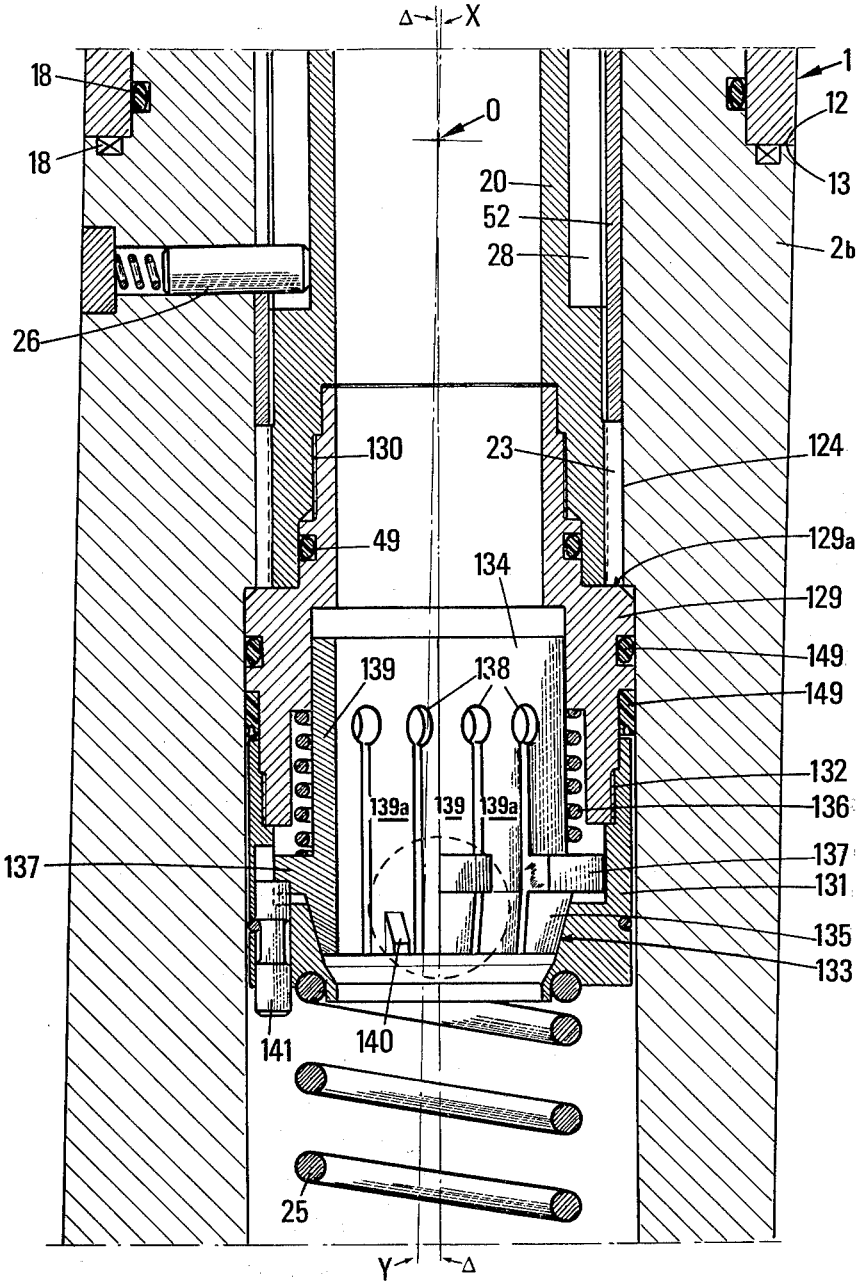
FIG. 14 shows, on a large scale, the control mechanism illustrated by FIG. 13A.

FIGS. 13A, 13B and 14 illustrate another embodiment of the crank connector according to the invention.

The upper member 1 is connected to the lower part 3 of the drill string by an intermediary connector 104 threaded at 4 and 4*a*. The lower element 2, which is formed by a plurality of elements 2*b*, 2*c* and 2*d* connected end to end by threadings 7 and 8, is secured to a downhole motor 109, such as a turbine, through a threading 10.

At the lower end of member 1 is arranged a bore 11 whose axis is Δ. The lower face 12 of member 1 is perpendicular to axis Δ and the plane which contains this face passes through the point of convergence of axes X'X and Δ.

The upper end of member 2 carries a fitting element 2*a* complementary to bore 11 and whose axis is at an angle α to the axis Y'Y of member 2. Member 2 has a shoulder 13 whose face perpendicular to the axis of the fitting element 2*a* is contained in a plane passing through the intersection of axis Y'Y and of the axis of fitting element 2*a*.

Tubular members 1 and 2 are maintained in interlocking position by an abutment 14 withstanding the axial stresses applied to the connector when in operation. Centering of element 2*a* in bore 11 is ensured by roll bearings such as those diagrammatically shown at 15, 16 and 17 which permit relative rotation of the two tubular members. Gaskets 18 and 19 ensure sealing between the two members 1 and 2.

Inside tubular members 1 and 2 a hollow shaft 20 is positioned coaxially to element 2*a* and bore 11, i.e. coaxially to axis Δ. Shaft 20 and member 1 are permanently fast in rotation with each other. This is obtained by the co-operation of a grooved bore 21 provided in the upper member 1 and of complementary grooves 22 provided on shaft 20. The latter is also provided with grooves 23 operative to co-operate with a grooved bore 24 of the lower member 2 when shaft 20 is displaced by the action of spring 25 to the position illustrated by FIG. 13A. In this position member 2 and shaft 20 are fast in rotation with each other. Shaft 20, which is displaceable within tubular members 1 and 2, is provided on its outer wall with a profiled guide groove 28 which co-operates with at least one guide finger 26 integral with member 2 for rotating the latter about axis Δ when shaft 20 is axially displaced from its position on FIG. 13A. This groove shown in perspective view in FIG. 3 permits stepwise rotation of tubular member 2 about axis Δ. The lower end of shaft 20 is provided with a control mechanism designated as a whole by reference 127 and shown on a larger scale in FIG. 14. This mechanism comprises a tubular piston 129 slidable in the bore of the lower member 2, this bore being coaxial to shaft 20. Piston 129 is secured to the end of shaft 20 by a threading 130. A flap seat 131 is located in the extension of hollow piston 129 to which it is connected through a threading 132.

This valve seat 131 has a conical bore 133 for receiving a tubular element 134 whose coaxial end 135 is complementary to bore 133. Element 134 forming a clack valve is axially slidable in a bore of hollow piston 129 and is subjected to the action of a spring 136 positioned between piston 129 and an external collar 137 of element 134. This element 134 is split parallel to its axis over a part of its length from its conical end. Cutout portions 138 define blades 139 of which at least three, which are regularly distributed, are flexible blades 139*a*, provided with protrusions 140 on their inner wall, while the collar 137 is omitted on their outer wall for reasons to be explained below. Valve seat 131 is also provided with a trigger 141 operative to move element 134 away from valve seat 131 in a particular position of shaft 20.

At its lower end (FIG. 13B) tubular element 2*d* is provided with a basket 142 coaxial with this tubular element.

This basket has an opening 143 at its upper end and leaves a free annular space 144 for the flow of drilling fluid. Preferably the walls of basket 142 are provided with apertures 145 wherethrough the drilling can flow.

To provide for an efficient lubrication of shaft 20 and of the different parts of mechanism 127, an oil reserve has been provided in the substantially confined annular space 146 delimited between the upper element 1 and shaft 20. This oil reserve has another function to be indicated in the description of the operation. This annular space is obturated at its upper part by a floating piston 147 whereby the oil pressure can be kept at the same value as the pressure of the drilling fluid feeding the crank connector and enabling to compensate for oil leakage, if any, by displacement of piston 147.

Gaskets 148 and 149 ensure sealing at the levels of the floating piston 147 and the control mechanism 127 respectively.

The operation of the device is indicated below, assuming that the crank connector is in the position shown in FIGS. 13A and 13B, the axes of tubular members 1 and 2 being aligned and the drilling having reached the depth at which the drill path is to be deflected.

Without interrupting the flow of drilling fluid a steel ball of selected diameter is introduced into the drill string. This ball is stopped by the protrusions 140 of the blades 139*a* as shown in dashed line in FIG. 14. This ball causes a pressure drop ΔP in the flow of drilling fluid. The pressure prevailing in the bore of shaft 20 is transmitted by the floating piston 147 (FIG. 13A) and the oil to the upper face 129*a* of piston 129. The flow of drilling fluid, acting directly on the ball and also on piston 129 by the pressure difference ΔP, displaces axially shaft 20 in the direction of the flow against the antagonistic action of spring 25. Finger 26 which was initially in position 26*a* (FIG. 4) reaches position 26*b*.

In this position grooves 23 of shaft 20 are disengaged from grooves 24 of the lower member 2 and consequently the shaft 20 is no longer fast in rotation with the lower member 2. When the shaft 20 is further axially displaced, finger 26 reaches the position 26*c* and rotates member 2 about axis Δ by an angle $\theta=[(2\pi/n)]$.

When the guide finger 26 reaches the position 26*c*, the trigger finger 141 comes into contact with a shoulder 150 of body member 2 (FIG. 13*b*) and keeps element 134 in position while shaft 20 and valve seat 131 are further displaced and compress spring 136.

From now on the conical part 135 of element 134 no longer contacts the conical fluid, the resilient blades 139*a* which are not provided with a collar 137 are moved apart from the axis of the device and the released ball falls into basket 142 (FIG. 13B) at the lower part of the coupling.

The pressure drop created by the ball being thus discontinued, piston 129 is no longer subjected to the pressure difference ΔP.

The calibrated spring 25 urges back shaft 25 upwardly, while spring 136 presses again element 134 against valve seat 131. Guide finger 26 passes from the position 26*c* to position 26*b'*, then to position 26*a'* where grooves 23 and 24 make shaft 20 fast in rotation with the lower member 2.

Shaft 20 is then in the same position as in FIG. 13A.

The same operating cycle can be repeated by introducing new steel balls into the drill string. The basket 142 may be emptied when the drill string is raised to the surface, for example for changing the drill bit. The capacity of basket 142 will be as high as possible, for example 10 to 20 balls or more.

The locking device described in relation with FIGS. 9 to 11E, using a ring or sleeve 52 around the guide groove 28 may also be used in this embodiment.

We claim:

1. A crank connector adapted for having its angle varied by remote control comprising: a first tubular member adapted for being secured at the lower end of a drill string and having a longitudinal axis, a second tubular member adapted for being connected to a downhole motor for rotating a drill bit and having a longitudinal axis, a rotary fitting having an axis of rotation, said second tubular member being rotatable, with respect to its longitudinal axis, about said axis of rotation of said rotary fitting, said axis of rotation and said longitudinal axes of said first and second tubular members being separated from each other and converging substantially at the same point to define respective acute angles, said rotary fitting comprising a connecting shaft connecting said first and second tubular members together and being slidable therein with said shaft being fixedly rotatably secured to one of said first and second tubular members and movable into a lock position with respect to the other of said first and second tubular members for being rotatably secured thereto, said shaft being axially displaceable with respect to said other of said first and second tubular members for being disengaged therefrom, angle remote control means for varying it will the angular position of said second tubular member with respect to said first tubular member by pivoting said second tubular member, with respect to its longitudinal axis, about said axis of rotation, maintenance means for maintaining said tubular members in a selected angular position with respect to each other, remotely controlled displacing means for axially displacing said connecting shaft, and driving means for transforming an axial displacement of said connecting shaft from its locking position into a rotation of said second tubular member about said axis of rotation.

2. A crank connector according to claim 1, wherein said angles formed between said axis of rotation and the respective longitudinal axes of said tubular members are substantially equal.

3. A crank connector according to claim 1, wherein said driving means comprising a profiled groove and a guide finger co-operating with said groove, one of said elements being carried by said connecting shaft and said other of said first and second tubular members with which said connecting shaft is secured for rotation exclusively in said locking position.

4. A crank connector according to claim 1, wherein said remotely controlled displacing means comprises a piston secured for rotation with said connecting shaft, said piston having at least a duct extending therethrough and communicating with the internal bore of said first tubular member for the passage of pressurized fluid, and closing means for remotely controlling the closing of said duct.

5. A crank connector according to claim 4 wherein said closing means comprises a disc having at least one aperture and being rotatably mounted in close vicinity to said piston, coaxially thereto, said disc having a position of closure with respect to said duct and being connected to remotely operable means for controlling its rotation.

6. A crank connector according to claim 1, comprising auxiliary means, for locking said tubular members against relative rotation to prevent any undesirable rotation of said tubular members after adjustment of their relative angular position.

7. A crank connector according to claim 1, comprising detecting means for remotely detecting the relative angular position of said second tubular member with respect to said first tubular member.

8. A crank connector according to claim 1, wherein said remotely controlled displacing means for remotely controlling the axial displacement of said connecting shaft comprises a first piston slidably received in the bore of said first tubular member, a second piston slidably received in the bore of said second tubular member, said first and second pistons being integral with said shaft and each having a duct communicating with the bore of said shaft, said second piston having a greater external diameter than said first piston, said pistons, said shaft and said two tubular members defining between one another an annular space, and fluid supply means feeding said annular space with a hydraulic fluid under a greater pressure than that prevailing in the bore of said shaft displacing said shaft from its locking position.

9. A crank connector according to claim 8, wherein said fluid supply means comprises a tank containing a hydraulic fluid and having at least a deformable wall portion, said tank being exposed to the pressure of the drilling fluid feeding the crank connector, a remotely controlled valve for sequentially putting said tank into communication with said annular space through a connecting duct, and pressure regulation means for creating a predetermined pressure drop in the flow of drilling fluid, said pressure regulation means being located upstream of said lower piston with respect to the direction of flow of the drilling fluid.

10. A crank connector according to claim 9, further comprising a chamber acting as a hydraulic compensator in communication with said annular space and of which at least one wall portion is deformable and subjected to the pressure prevailing inside said shaft.

11. A crank connector according to claim 10, further comprising a control line whereby said valve can be remotely actuated by an electric signal transmitted through said control line.

12. A crank connector according to claim 10, wherein said pressure regulation means is adapted for providing a pressure drop independent of the flow rate of the drilling fluid.

13. A crank connector according to claim 10, comprising reducing means for reducing the cross-section of said duct extending through said second piston when said shaft is in a predetermined non-locking position.

14. A crank connector according to claim 6, wherein said auxiliary locking means comprises a sleeve surrounding said shaft, said sleeve having a substantially longitudinal extending groove adapted for receiving said guide finger, said sleeve including teeth at one of its ends, and said shaft having complementary teeth, so that said sleeve and said shaft can be secured for rotation with each other when said shaft is not in its locking position.

15. A crank connector according to claim 1, wherein said remotely controlled displacing means for remotely controlling the axial displacement of said shaft comprises a piston which is integral with said shaft, said piston having a duct extending therethrough in communication with the bore of said shaft and defining with said bore a passage for the drilling fluid, and a closing element operative for closing at least partly the duct in said piston to produce in the flow of drilling fluid a pressure drop sufficient to displace said piston from its locking position.

16. A crank connector according to claim 15, wherein said closing element for closing the duct in said piston comprises a valve seat integral with said piston, a tubular valve member displaceable in the bore of said piston and subjected to the action of resilient means urging said valve member against said valve seat, said valve member being provided with axially extending splits over a fraction of its length, which define at least three resilient blades whose internal walls are provided with protrusions reducing the cross-section of the bore of said valve member when said valve member is urged against said valve seat, a ball contacting said protrusions when said valve member is urged against said valve seat, at least one trigger finger operative for causing a relative displacement of said valve member with respect to said valve seat in a predetermined position of said shaft, thereby enabling said protrusions to move apart from the valve axis by resilient deformation of said blades giving passage to said ball, and a basket for collecting said ball when said ball has passed through said valve.

17. A crank connector according to claim 1, wherein said piston is secured to the lower part of said shaft, and a floating piston is positioned at the upper part of said shaft, said shaft and said tubular elements defining substantially confined space filled up with hydraulic fluid, said floating piston being exposed to the pressure of the drilling fluid feeding the crank connector.

* * * * *